US011542940B2

(12) United States Patent
Peters

(10) Patent No.: US 11,542,940 B2
(45) Date of Patent: Jan. 3, 2023

(54) ROTARY PUMP HAVING AN ADJUSTABLE SPECIFIC DELIVERY VOLUME AND A PRESSURE EQUALIZATION SURFACE

(71) Applicant: Schwäbische Hüttenwerke Automotive GmbH, Aalen-Wasseralfingen (DE)

(72) Inventor: Sven Peters, Bad Schussenried (DE)

(73) Assignee: Schwäbische Hüttenwerke Automotive GmbH, Aalen (DE)

( * ) Notice: Subject to any disclaimer, the term of this patent is extended or adjusted under 35 U.S.C. 154(b) by 78 days.

(21) Appl. No.: 17/166,261

(22) Filed: Feb. 3, 2021

(65) Prior Publication Data

US 2021/0246899 A1 Aug. 12, 2021

(30) Foreign Application Priority Data

Feb. 6, 2020 (DE) ..... 10 2020 103 081.9

(51) Int. Cl.
*F03C 2/00* (2006.01)
*F03C 4/00* (2006.01)
(Continued)

(52) U.S. Cl.
CPC ..... *F04C 2/3442* (2013.01); *F04C 14/20* (2013.01); *F04C 14/223* (2013.01); *F04C 15/0049* (2013.01); *F04C 2210/206* (2013.01)

(58) Field of Classification Search
CPC ..... F04C 2/344; F04C 2/3442; F04C 14/20; F04C 14/22; F04C 14/223; F04C 15/0049; F04C 2210/206
See application file for complete search history.

(56) References Cited

U.S. PATENT DOCUMENTS 2,929,329 A * 3/1960 De Loss ..... F04C 14/223 418/26
9,932,982 B2 4/2018 Braasch
(Continued)

FOREIGN PATENT DOCUMENTS

CN 105715547 A 6/2016
DE 2551451 A1 5/1977
(Continued)

OTHER PUBLICATIONS

German Search Report issued in German Application No. 10 2020 103 081.9, dated Oct. 9, 2020, 6 pages.
(Continued)

*Primary Examiner* — Theresa Trieu
(74) *Attorney, Agent, or Firm* — RatnerPrestia

(57) ABSTRACT

A rotary pump includes: a housing featuring a housing inlet and a low-pressure space on a low-pressure side of the pump and featuring a housing outlet and a high-pressure space on a high-pressure side of the pump; a delivery chamber; a delivery rotor in the delivery chamber; a setting structure which can be moved in a first setting direction and, counter to the first setting direction, in a second setting direction in order to perform a setting movement which adjusts the specific delivery volume of the rotary pump; and at least a first setting chamber for charging the setting structure with a setting pressure which acts in the second setting direction, wherein the fluid pressure in the high-pressure space acts on a pressure equalization surface on the outer circumference of the setting structure resulting in an external additional force which acts on the setting structure in the first setting direction.

21 Claims, 2 Drawing Sheets

(51) Int. Cl.

| | |
|---|---|
| ***F04C 2/00*** | (2006.01) |
| ***F04C 2/344*** | (2006.01) |
| ***F04C 14/20*** | (2006.01) |
| ***F04C 15/00*** | (2006.01) |
| ***F04C 14/22*** | (2006.01) |

(56) References Cited

U.S. PATENT DOCUMENTS

| | | | | |
|---|---|---|---|---|
| 10,801,494 | B2 | 10/2020 | Senbongi et al. | |
| 2016/0363120 | A1* | 12/2016 | Meinig | F04C 14/18 |
| 2017/0167484 | A1* | 6/2017 | Peters | F04C 14/223 |
| 2019/0017596 | A1* | 1/2019 | Senbongi | F04C 14/223 |

FOREIGN PATENT DOCUMENTS

| | | | | |
|---|---|---|---|---|
| DE | 102007018692 | A1 | 10/2008 | |
| DE | 102012103406 | A1 | 11/2012 | |
| DE | 102015117433 | A1 * | 4/2017 | F04C 14/226 |
| DE | 102018106840 | A1 | 1/2019 | |
| DE | 112017008081 | T5 | 7/2020 | |
| WO | 2019091559 | A1 | 5/2019 | |
| WO | 2019137664 | A1 | 7/2019 | |

OTHER PUBLICATIONS

Extended European Search Report for European Application No. 21 154 813.6, dated Mar. 31, 2021, with translation; 12 pages.
Chinese Office Action for Chinese Application No. 202110156285.8, dated Jul. 27, 2022 with translation, 31 pages.

* cited by examiner

ROTARY PUMP HAVING AN ADJUSTABLE SPECIFIC DELIVERY VOLUME AND A PRESSURE EQUALIZATION SURFACE

CROSS REFERENCE TO RELATED APPLICATION

This application claims benefit of priority from German Patent Application No. 10 2020 103 081.9, filed Feb. 6, 2020. The contents of this application are incorporated herein by reference.

FIELD OF THE INVENTION

The invention relates to a rotary pump having an adjustable specific delivery volume, in particular a vane cell pump. Rotary pumps such as the invention relates to in particular are used in vehicles in order for example to deliver lubricants. Such lubricating oil pumps are driven by the engine of the vehicle which is to be supplied with the lubricating oil, as a direct function of the rotational speed of the engine. Accordingly, the rotational speed of the pump increases with the rotational speed of the engine. If the specific delivery volume is invariable, an increase in the rotational speed causes an increase in the delivery volume. Since the lubricating oil requirement of motor vehicles is only conditionally dependent on the rotational speed of the engine, rotary pumps having an adjustable specific delivery volume have in the past been developed in order to regulate the volume flow in accordance with operations.

BACKGROUND OF THE INVENTION

Rotary pumps such as the invention relates to in particular have a so-called setting structure for adjusting the specific delivery volume. In vane cell pumps in particular, this setting structure is formed by a setting ring which surrounds the delivery chamber of the vane cell pump and whose inner contour delineates the individual delivery cells radially outwards. Adjusting the setting structure increases or decreases the specific delivery volume, i.e. the delivery volume per revolution of a pump rotor, depending on the setting direction. Rotary pumps, in particular vane cell pumps, are for example known from the prior art in which a restoring element, in particular a restoring spring, acts on the setting structure in the direction of the maximum specific delivery volume. The setting structure is adjusted by charging one or more setting chambers with the pressure of a setting fluid, wherein the setting chamber or chambers is/are arranged along the setting structure in such a way that the setting fluid acting on the setting structure generates a force in the opposite direction to the force of the restoring element. The setting fluid required for adjusting is expediently diverted, on the high-pressure side of the pump, from the fluid to be delivered.

The forces acting on the setting structure, in particular the external forces such as the restoring force of the restoring element and the setting force generated in the setting chamber, and optionally setting forces generated in one or more other setting chambers, are in equilibrium depending on the operating state of the rotary pump. By changing the force equilibrium, it is possible to change the specific delivery volume of the pump by adjusting the setting structure. In rotary pumps of this type, the setting force or forces must overcome the restoring force of the restoring element in order to govern the pump, i.e. reduce the specific delivery volume. This means that the setting chamber or chambers and the restoring element are mutually adjusted such that the setting forces generated by means of the setting chamber or chambers must overcome the restoring force of the restoring element in order to govern, for example as a function of the rotational speed of the pump.

In addition to the external forces described above, internal forces also act on the setting structure. These internal forces are generated by the fluid pressure of the fluid situated in the delivery chambers, which acts on the inner contour of the setting structure. Internal force components which are directed radially outwards act on the inner contour of the setting structure in a distribution over the circumference. Adding up the individual internal force components gives a resultant internal force directed radially outwards. Depending on the effective direction of the resultant internal force, this can lead to unintentional regulating characteristics in the pump. Depending on the effective direction of the internal force, the pump can for example govern prematurely and unintentionally, or the setting pressure required for governing is increased by the magnitude of the internal force, leading to delayed governing of the pump.

SUMMARY OF THE INVENTION

Therefore, an aspect of the invention is directed to improve the regulating characteristics of the rotary pump.

An aspect of the invention is based on a rotary pump, in particular a vane cell pump, which comprises a housing featuring a housing inlet situated on the low-pressure side and a housing outlet situated on the high-pressure side of the rotary pump. The housing inlet is connected to a low-pressure space situated within the housing. The fluid, in particular the lubricating oil, is suctioned from a reservoir by the rotary pump via the housing inlet and discharged at an increased pressure to the assembly to be supplied via the housing outlet. If the rotary pump is a vacuum pump, the assembly to be supplied is correspondingly situated on the suction side of the rotary pump. In addition to the low-pressure space connected to the housing inlet, the housing comprises at least one high-pressure space which is connected to the housing outlet.

The housing also comprises at least one delivery chamber which is connected to the low-pressure space via a delivery chamber inlet on the low-pressure side and to the high-pressure space via a delivery chamber outlet on the high-pressure side. The delivery chamber inlet and the delivery chamber outlet can be shaped in the form of a suction pocket or pressure pocket or other cavity. The delivery chamber inlet and/or the delivery chamber outlet can be formed in an axially front delineation of the delivery chamber and/or in an axially rear delineation of the delivery chamber and/or in a radial delineation of the delivery chamber, wherein it is not necessary for the delivery chamber inlet to be embodied in the same way as the delivery chamber outlet.

The axially front delineation of the delivery chamber can for example be formed by a housing cover, while the axially rear delineation of the delivery chamber can for example be formed by the housing itself, for example by the base of a housing cavity. The radial delineation of the delivery chamber can be formed by a setting structure which can be moved, preferably back and forth, in order to perform a setting movement which adjusts the specific delivery volume of the rotary pump. The delivery chamber inlet and/or the delivery chamber outlet can be formed by a cavity and/or aperture in the radial delineation and/or by a cavity on the axial front delineation and/or by a cavity on the axially rear delineation of the delivery chamber.

In preferred embodiments, the delivery chamber inlet is formed in the shape of a suction pocket in the region of the axially rear delineation of the delivery chamber and a cavity on the axially front edge of the setting structure. In the same way, the delivery chamber outlet is preferably formed in the shape of a pressure pocket in the region of the axially rear delineation of the delivery chamber and a cavity on the axially front edge of the setting structure. The cavity in the setting structure for the delivery chamber inlet at least partially and preferably completely overlaps with the suction pocket in the circumferential direction. Similarly, the cavity for the delivery chamber outlet at least partially and preferably completely overlaps with the pressure pocket in the circumferential direction.

The central angle spanned by the cavity in the setting structure for the delivery chamber inlet can be smaller than or equal to the central angle spanned by the suction pocket. The central angle for the suction pocket is defined by the axis of rotation of the pump rotor and the respective start and end points in the circumferential direction, and the central angle of the cavity in the setting structure is defined by the center of the inner contour of the setting structure and the respective start and end points in the circumferential direction. The central angle of the suction pocket is preferably less than 180°, particularly preferably less than 170°. The central angle of the cavity for the delivery chamber inlet is preferably less than 90°, particularly preferably less than 80°.

The central angle spanned by the cavity in the setting structure for the delivery chamber outlet can be smaller than or equal to the central angle spanned by the pressure pocket. The definitions for the central angle of the suction pocket apply similarly to the central angle of the pressure pocket. Similarly, the definitions for the cavity in the setting structure for the delivery chamber inlet apply similarly to the cavity in the setting structure for the delivery chamber outlet. The central angle of the pressure pocket is preferably less than or equal to 180°, particularly preferably less than or equal to 120°. The central angle of the cavity for the delivery chamber outlet is preferably less than or equal to 90°, particularly preferably less than or equal to 80°. In preferred embodiments, the central angle spanned by the cavity in the setting structure for the delivery chamber outlet is greater than the central angle spanned by the cavity in the setting structure for the delivery chamber inlet, and the central angle spanned by the pressure pocket is smaller than the central angle spanned by the suction pocket.

The delivery chamber inlet and the delivery chamber outlet are spaced from one another in the circumferential direction of the setting structure and are preferably arranged opposite one another across the axis of rotation of the pump rotor. For the purposes of the invention, "arranged opposite one another" means that the delivery chamber can be notionally divided into a first circular segment and a second circular segment, each of which encompasses an angle of 180°, wherein the delivery cells in the first notional circular segment increase in size in the direction of rotation of the rotor and the delivery cells in the second notional circular segment decrease in size in the direction of rotation of the rotor. The delivery chamber inlet is preferably formed in the first of the two circular segments, and the delivery chamber outlet is preferably formed in the second of the two circular segments.

The delivery chamber is delimited in the radial direction by the inner contour of the setting structure. The setting structure can in particular be formed in the shape of a setting ring featuring an outer circumferential surface and an inner circumferential surface. The inner circumferential surface of the surface area can for example correspond to a circular cylinder, wherein the inner circumferential surface of the setting structure forms the radial delineation of the delivery chamber.

The setting structure can be moved back and forth in a first setting direction and, opposite to the first setting direction, in a second setting direction in order to perform a setting movement which adjusts the specific delivery volume of the rotary pump. In preferred embodiments, the setting structure can be moved linearly back and forth in the first setting direction and in the second setting direction, although a pivoting movement is also conceivable. The setting structure preferably has a first sliding surface and a second sliding surface which serve to guide the setting structure. The first sliding surface and the second sliding surface are preferably formed on a first shoulder and a second shoulder of the setting structure. The first shoulder and the second shoulder project radially outwards from the setting structure. The setting movement of the setting structure in the first setting direction increases the delivery volume, and the setting movement of the setting structure in the second setting direction reduces the delivery volume. The first sliding surface can be formed directly by the setting structure. The first sliding surface can instead however also be formed by a sealing element which is arranged on the outer circumference of the setting structure. The second sliding surface can be formed directly by the setting structure. The second sliding surface can instead however also be formed by a sealing element which is arranged on the outer circumference of the setting structure, wherein both the first sliding surface and the second sliding surface can be formed directly by the setting structure or, instead, each formed by a sealing element arranged on the outer circumference of the setting structure. In another variant, one of the sliding surfaces, for example the first sliding surface, can be formed directly by the setting structure, and the other of the sliding surfaces can be formed by a sealing element arranged on the outer circumference of the setting structure.

In order to charge the setting structure with a setting pressure of a setting fluid which acts in the first setting direction or the second direction, the pump comprises at least a first setting chamber formed along a part of the outer circumferential surface of the setting structure. The outer circumference of the setting structure has a pressure setting surface which forms a movable delineating wall of the first setting chamber. Charging the first setting chamber, in particular the pressure setting surface, with a setting pressure of a setting fluid generates a resultant first setting force which acts on the setting structure in the first setting direction or in the second setting direction. In preferred embodiments, the setting pressure of the setting fluid in the first setting chamber acts in the second setting direction. The setting pressure in the first setting chamber particularly preferably acts permanently on the setting structure.

Preferably, at least a second setting chamber is formed, offset with respect to the first setting chamber in the circumferential direction of the setting structure. The second setting chamber serves to charge the setting structure with a setting pressure of a setting fluid which acts in the first setting direction or in the second setting direction. The outer circumference of the setting structure has a second pressure setting surface which forms a movable delineating wall of the second setting chamber. Charging the second setting chamber, in particular the second pressure setting surface, with a setting pressure of a setting fluid generates a resultant second setting force which acts on the setting structure in the first setting direction or in the second setting direction. The second setting force generated in the second setting chamber by the setting pressure of the setting fluid can act counter to the first setting force generated in the first setting chamber by the setting pressure of the setting fluid. The first setting force and the second setting force can however instead also act at least substantially in the same direction. In preferred embodiments, the first setting force and the second setting force act in the second setting direction.

The first setting chamber and/or the second setting chamber can each be permanently charged with a setting pressure. In preferred embodiments, at least one of these setting chambers can be actuated, i.e. selectively charged with pressure or relieved of pressure, via a control valve. The second setting chamber, if provided, can preferably be actuated via a control valve and thus charged with a setting pressure of a setting fluid in accordance with the position of the control valve.

The first setting chamber and the second setting chamber are arranged next to one another, preferably directly next to one another, with an offset in the circumferential direction of the setting structure. The first setting chamber and the second setting chamber are separated in the circumferential direction of the setting structure by a sliding surface. In preferred embodiments, the first setting chamber and the second setting chamber are separated from one another by a gasket which is preferably accommodated in a cavity on the outer circumference of the setting structure.

The setting fluid used to charge the first setting chamber and/or the second setting chamber with pressure is preferably diverted from the high-pressure side of the rotary pump, for example from a point in the housing still upstream of the housing outlet. The fluid is fed to the first setting chamber and/or the second setting chamber via fluid conduits, wherein for example control valves or devices for throttling the fluid pressure can be arranged in the fluid conduits. The first setting chamber and the second setting chamber, if the latter is provided, are preferably not directly connected to one another in fluid communication, i.e. setting fluid preferably does not flow from the first setting chamber directly into the second setting chamber or from the second setting chamber directly into the first setting chamber.

Removing the setting fluid from the high-pressure side of the rotary pump changes the setting force generated by the setting pressure in the first setting chamber when the first setting chamber is charged with pressure. Similarly, the setting force generated by the setting pressure in the second setting chamber, if provided, when the second setting chamber is charged with pressure changes with the rotational speed of the rotary pump. In other words, a high rotational speed of the rotary pump results in a high fluid pressure on the high-pressure side of the rotary pump, which results in a large first setting force generated in the first setting chamber and likewise a large second setting force generated in the second setting chamber, if provided, wherein the first setting force and the second setting force preferably act in the second setting direction, in the direction of reducing the specific delivery volume, wherein the setting force generated in the first setting chamber is dependent on the delivery rate of the rotary pump, wherein a high delivery rate generates a high setting force. Equally, the setting force when the second setting chamber is charged with pressure is dependent on the delivery rate of the rotary pump, wherein a high delivery rate generates a high setting force. In preferred embodiments, the setting force generated in the first setting chamber acts permanently on the setting structure, wherein the setting force generated in the optional second setting chamber can preferably be regulated via a control valve.

At least one restoring chamber is formed, offset with respect to the one or more setting chambers in the circumferential direction of the outer circumferential surface of the setting structure. The restoring chamber serves to generate a restoring force which acts on the outer circumferential surface of the setting structure in the first setting direction or in the second setting direction. In preferred embodiments, the restoring force acts counter to the first setting force and/or the second setting force. The restoring force preferably acts in the direction of increasing the delivery volume, i.e. in the first setting direction, and the first setting force and the optional second setting force acts/act in the direction of reducing the delivery volume, i.e. in the second setting direction.

The restoring force can be generated by a restoring element and/or by charging the restoring chamber with the pressure of a setting fluid. A restoring element, preferably a restoring spring, which generates a restoring force which acts on the setting structure is preferably situated in the restoring chamber. The restoring force generated by the restoring element preferably acts permanently on the setting structure. In preferred embodiments, the restoring force acts in the first setting direction. It is also conceivable to charge the restoring chamber with a setting pressure of a setting fluid which acts in the first setting direction or in the second setting direction, such as can in particular be used in the first setting chamber and/or in the optional second setting chamber, solely or in addition to the restoring element. In this way, the restoring element can be assisted by an additional restoring force, wherein the additional restoring force depends on the rotational speed of the pump in a similar way to the setting force.

The restoring chamber can be embodied as a separate chamber; in preferred embodiments, the restoring chamber is a part of the low-pressure space or can at least be connected to the low-pressure space, wherein "can be connected" means that the restoring chamber can be connected in fluid communication to the low-pressure space or is permanently connected in fluid communication to the low-pressure space. In preferred embodiments, the optional restoring chamber is permanently connected in fluid communication to the low-pressure space, for example via a cavity in the setting structure, and/or to the low-pressure side of the delivery chamber via a suction pocket.

The high-pressure space is connected in fluid communication to the delivery chamber, namely to the high-pressure side of the delivery chamber. In preferred embodiments, the high-pressure space is permanently connected in fluid communication to the delivery chamber. The fluid connection between the delivery chamber and the high-pressure space can be formed by a cavity on the end-facing side and/or by an aperture in the setting structure and/or by a cavity in the housing. The fluid connection is preferably formed by a cavity or an aperture in the setting structure. In particularly preferred embodiments, this cavity in the setting structure is the delivery chamber outlet. In addition to the cavity in the setting structure, the high-pressure space can be connected to the delivery chamber via a pressure pocket of the delivery chamber outlet. The pressure pocket and the cavity in the setting structure are preferably formed on axially opposite sides of the setting structure, such that the fluid flowing off out of the delivery chamber flows around the setting structure on both axial sides.

Preferably, most of the fluid which flows off out of the delivery chamber through the delivery chamber outlet flows into the high-pressure space, in particular directly into the high-pressure space, and flows off out of the high-pressure space via the housing outlet from the pump housing, wherein this can advantageously be most of the fluid delivered as a whole by the pump. The high-pressure space forms an antechamber of the housing outlet. The high-pressure space is formed downstream of the delivery chamber outlet and upstream of the housing outlet in the housing. Part of the outer circumferential surface of the setting structure forms a movable delineating wall of the high-pressure space.

In addition to external forces, internal forces also act on the setting structure. These internal forces are generated by the fluid pressure of the fluid situated in the delivery chamber, wherein said fluid pressure acts on the inner contour of the setting structure. Since the internal force depends on the pressure conditions prevailing in the delivery chamber, which are determined in part by the rotational speed of the pump, the internal force is proportional to the rotational speed of the pump when setting movements of the setting structure are disregarded or the setting structure is fixed. At a high rotational speed, the resultant internal force is correspondingly greater than at a comparatively lower rotational speed. The internal forces acting on the setting structure are greater on the high-pressure side of the delivery chamber than the internal forces on the low-pressure side of the delivery chamber. Adding up the forces along the inner contour of the setting structure gives a resultant internal force directed radially outwards on the high-pressure side of the delivery chamber, in particular in the region of the delivery chamber outlet.

Depending on the pressure conditions in the delivery chamber, the resultant internal force can for example act in the opposite direction to the restoring element or in the same direction as the restoring element. Depending on the effective direction of the resultant internal force, this can lead to unintentional regulating characteristics in the pump. In accordance with the effective direction of the internal force, the pump can for example govern prematurely and unintentionally, or the setting pressure required for governing is increased by the magnitude of the internal force, leading to delayed governing of the pump.

The resultant internal force can in principle be broken down into a first force component and a second force component which is orthogonal to the first force component, wherein the first force component acts in the first setting direction or in the second setting direction. The first force component and the second force component can differ in magnitude. Since, in addition to temporary pressure fluctuations, local pressure fluctuations can also occur within the delivering chamber while the pump is in operation, for example during a load change, the relationship between the first force component and the second force component can vary. If the first force component or the second force component has a value of zero, the resultant internal force corresponds to the other force component in each case. The internal force can thus for example correspond to the first force component.

The first force component is preferably greater than the second force component. It is however also conceivable, depending on the arrangement of the high-pressure side and the low-pressure side of the delivery chamber, for the second force component to be greater than the first force component. In principle, the internal force always has a first force component which acts in the first setting direction or in the second setting direction, wherein the first force component can also have a value of zero. In preferred embodiments, the first force component acts in the second setting direction. Since the setting structure can be moved back and forth in the first and second setting direction, preferably linearly, and cannot be moved orthogonally with respect to the setting directions, the second force component is compensated for by the bearing of the setting structure. If the internal force has a second force component which is greater than zero and the pressure in the high-pressure space exerts a transverse force on the setting structure, then in advantageous embodiments, the high-pressure space is arranged relative to the setting structure such that the transverse force exerted on the setting structure by the pressure in the high-pressure space acts counter to the second force component of the internal force.

A resultant internal force and/or first force component in the first setting direction, i.e. in the restoring direction, means that the force which has to be applied in order to govern the pump increases with the rotational speed. Correspondingly, a resultant internal force and/or first force component in the second setting direction, i.e. counter to the restoring direction, increases the risk of the pump being governed unintentionally. In preferred embodiments, the high-pressure side of the delivery chamber and in particular the delivery chamber outlet is arranged in such a way that the first force component acts in the second setting direction and thus counter to an optional restoring element. In particularly preferred embodiments, the high-pressure side and in particular the delivery chamber outlet is arranged in such a way that the first force component acts in the second setting direction and the second force component is equal to zero. The resultant internal force, more specifically the first force component of the resultant internal force, governs the rotary pump in such embodiments.

In order to counteract unintentional governing of the pump and to compensate for the resultant internal force, the high-pressure space comprises a pressure equalization surface. The pressure equalization surface corresponds to the outer circumferential surface of the setting structure situated in the high-pressure space. The pressure equalization surface is a part of the outer circumferential surface of the setting structure. The outer circumference of the setting structure in the high-pressure space has a pressure surface asymmetry which provides an effective pressure equalization surface. The pressure equalization surface of the setting structure forms a movable wall of the high-pressure space.

The pressure equalization surface can comprise a plurality of pressure surfaces, i.e. the pressure equalization surface can exhibit at least one inflection point. The pressure equalization surface can thus for example be corrugated or fluted in the circumferential direction of the setting structure.

In mathematical terms, the pressure equalization surface is represented by its normal vector. The normal vector is composed of a setting direction component which is parallel to the first and second setting direction, a transverse component which points transversely with respect to the setting directions, and an axial component which is parallel to the axis of rotation of the delivery rotor. If the outer circumference of the setting structure is cylindrical, the axial component is zero and can otherwise be disregarded in terms of the invention. The invention configures the pressure equalization surface such that the setting direction component of the normal vector points in the direction of the internal force which acts on the setting structure due to the pressure conditions in the delivery chamber. The pressure which prevails in the high-pressure space therefore acts counter to the internal force and therefore generates the external additional force which is directed counter to the internal force. The magnitude of the setting direction component of the normal vector corresponds to the size of the effective pressure equalization surface.

The pressure surface asymmetry of the pressure equalization surface can in particular result from offsetting the first sliding surface and the second sliding surface transversely, preferably orthogonally, with respect to the first and second setting direction. In preferred embodiments, in which the setting structure is mounted in the housing such that it can be moved linearly back and forth in the first and second setting direction, the first sliding surface and the second sliding surface are offset parallel to one another and orthogonally with respect to the first and second setting directions. If the two sliding surfaces of the linearly movable setting structure are notionally extended in the first setting direction and the second setting direction, the pressure equalization surface enclosed by these parallel lines forms the effective pressure equalization surface. The effective pressure equalization surface is the part of the pressure equalization surface which serves to generate the external additional force, wherein the effective pressure equalization surface is a part of the outer circumferential surface of the setting structure, wherein the effective pressure equalization surface corresponds to the projection of the pressure equalization surface in the first or second setting direction. The width of the effective pressure equalization surface as measured orthogonally with respect to the axis of rotation is determined by the transverse offset of the sliding surfaces.

The effective pressure equalization surface can also be calculated from the difference between the projections of the individual partial pressure surfaces of the pressure equalization surface in the first setting direction and the projections of the individual partial pressure surfaces of the pressure equalization surface in the second setting direction, wherein all the partial pressure surfaces whose normal vector has a component in the direction of the first setting direction are projected in the second setting direction, and all the partial pressure surfaces whose normal vector has a component in the direction of the second setting direction are projected in the first setting direction. The sum of the projections in the first setting direction gives a first pressure surface, and the sum of the projections in the second setting direction gives a second pressure surface. The difference between the first pressure surface and the second pressure surface, multiplied by the axial length of the pressure equalization surface, is the effective pressure equalization surface. In preferred embodiments, the first pressure surface is larger than the second pressure surface, but it is also conceivable for the second pressure surface to be larger than the first pressure surface.

In the high-pressure space, an external force generated by the fluid pressure in the high-pressure space acts in the first setting direction or instead in the second setting direction via the pressure equalization surface. If the pressure equalization surface describes a circular arc, the center of which coincides with the center of the setting structure, the external forces act radially inwards on the center of the setting structure. Adding up the forces along the pressure equalization surface gives a resultant external force. The resultant external force can be broken down into a first external force component and a second external force component which is perpendicular to the external first force component, wherein the external first force component acts in the first setting direction or in the second setting direction, wherein the fluid pressure in the high-pressure space which acts on the first partial pressure surface generates an external first force component in the direction of the first setting direction, while the fluid pressure in the high-pressure space which acts on the second partial pressure surface generates an external first force component in the second setting direction, wherein the fluid pressure acting on the first pressure surface and the fluid pressure acting on the second pressure surface are equal in size. The difference in area between the first pressure surface and the second pressure surface generates an external additional force. The external additional force corresponds to the resultant external force generated by the fluid pressure in the high-pressure space which acts on the pressure equalization surface. The external additional force is the product of the fluid pressure prevailing in the high-pressure space and the effective pressure equalization surface.

In preferred embodiments, the effective pressure equalization surface is dimensioned such that the fluid which preferably passes from the delivery chamber into the high-pressure space via the setting structure, generates an external additional force which is at least substantially as large in magnitude as the first force component of the internal force. The external additional force preferably acts in the opposite direction to the first force component of the resultant internal force. In particularly preferred embodiments, the external additional force compensates for the first force component of the internal force. In the preferred embodiments, the external additional force is thus an equalizing force which acts counter to the internal force. If, for example, the first force component of the internal force acts in the second setting direction, then the external additional force acts in the first setting direction. Preferably, the external additional force acts in the same direction as the restoring element. In such embodiments, the effective direction of the effective pressure equalization surface which is charged with fluid pressure is opposite to the effective direction of the pressure setting surface of the first setting chamber which is charged with fluid pressure and/or to the pressure setting surface of the second setting chamber which is charged with fluid pressure, if the latter is implemented.

The pressure equalization surface can extend on the outer circumference of the setting structure, in particular over a circumferential region which extends between a circumferential surface region of the setting structure on the low-pressure side of the pump and the setting chamber. If the pump has a plurality of setting chambers located on the outer circumference of the setting structure, the pressure equalization surface advantageously extends between a circumferential region of the setting structure on the low-pressure side and the plurality of setting chambers. If the pump has the restoring element mentioned, the pressure equalization surface advantageously extends on the outer circumference of the setting structure between the restoring element and the setting chamber or, optionally, the plurality of setting chambers.

In preferred embodiments, the effective pressure equalization surface is arranged on the outer circumference of the setting structure in the region of the delivery chamber outlet. It can however also be arranged, offset with respect to the delivery chamber outlet in the circumferential direction, on the outer circumference of the setting structure. The effective pressure equalization surface is preferably smaller than the setting surface formed by the outer circumferential surface of the setting structure in the first setting chamber and/or the optional second setting chamber. In advantageous embodiments, the size of the pressure equalization surface measures at most 20% or at most 10% of the setting surface of the first setting chamber or the optional second setting chamber. In preferred embodiments, the size of the effective pressure equalization surface measures at most 7% of the respective setting surface.

Features of the invention are also described in the aspects formulated below. The aspects are worded in the manner of claims and can substitute for them. Features disclosed in the aspects can also supplement and/or qualify the claims, indicate alternatives with respect to individual features and/or broaden claim features. Bracketed reference signs below refer to example embodiments of the invention illustrated in figures. They do not restrict the features described in the aspects to their literal sense as such, but do conversely indicate preferred ways of implementing the respective feature.

Aspect 1. A rotary pump having an adjustable specific delivery volume, preferably a vane pump, the rotary pump comprising:

(a) a housing (1) featuring a housing inlet and a low-pressure space (11), connected to the housing inlet, on a low-pressure side of the pump and featuring a housing outlet and a high-pressure space (21), connected to the housing outlet, on a high-pressure side of the pump;

(b) a delivery chamber into which a delivery chamber inlet (10) connected to the low-pressure space (11) opens on the low-pressure side and into which a delivery chamber outlet (20) connected to the high-pressure space (21) opens on the high-pressure side;

(c) a delivery rotor (2) which can be rotated about an axis of rotation in the delivery chamber;

(d) a setting structure (3) which can be moved back and forth in a first setting direction and, counter to the first setting direction, in a second setting direction in order to perform a setting movement which adjusts the specific delivery volume of the rotary pump; and (e) at least a first setting chamber (22) for charging the setting structure (3) with a setting pressure of a setting fluid which acts in the second setting direction, (f) wherein the fluid pressure in the high-pressure space (21) acts on a pressure equalization surface (3*a*) on the outer circumference of the setting structure (3), and the pressure equalization surface (3*a*) has a pressure surface asymmetry, resulting in an external additional force ($F_a$) which acts on the setting structure (3) in the first setting direction.

Aspect 2. A rotary pump having an adjustable specific delivery volume, preferably a vane pump, the rotary pump comprising:

(a) a housing (1) featuring a housing inlet and a low-pressure space (11), connected to the housing inlet, on a low-pressure side of the pump and featuring a housing outlet and a high-pressure space (21), connected to the housing outlet, on a high-pressure side of the pump;

(b) a delivery chamber into which a delivery chamber inlet (10) connected to the low-pressure space (11) opens on the low-pressure side and into which a delivery chamber outlet (20) connected to the high-pressure space (21) opens on the high-pressure side;

(c) a delivery rotor (2) which can be rotated about an axis of rotation in the delivery chamber;

(d) a setting structure (3) which can be moved back and forth in a first setting direction and, counter to the first setting direction, in a second setting direction in order to perform a setting movement which adjusts the specific delivery volume of the rotary pump; and (e) at least a first setting chamber (22), provided in addition to the high-pressure space or formed by the high-pressure space, for charging the setting structure (3) with a setting pressure of a setting fluid which acts in the second setting direction, (f) wherein the fluid situated in the delivery chamber exerts a resultant internal force ($F_i$) on the setting structure (3) which acts in one of the setting directions, for example in the second setting direction, (g) wherein the fluid pressure in the high-pressure space (21) acts on a pressure equalization surface (3*a*) on the outer circumference of the setting structure (3), and the pressure equalization surface (3*a*) has a pressure surface asymmetry, resulting in an external additional force ($F_a$) which acts on the setting structure (3), counter to the internal force ($F_i$).

Aspect 3. A rotary pump having an adjustable specific delivery volume, preferably a vane pump, the rotary pump comprising:

(a) a housing (1) featuring a housing inlet and a low-pressure space (11), connected to the housing inlet, on a low-pressure side of the pump and featuring a housing outlet and a high-pressure space (21), connected to the housing outlet, on a high-pressure side of the pump;

(b) a delivery chamber comprising a delivery chamber inlet (10) on the low-pressure side and a delivery chamber outlet (20) on the high-pressure side;

(c) a setting structure (3) which can be moved back and forth in a first setting direction and, counter to the first setting direction, in a second setting direction in order to perform a setting movement which adjusts the specific delivery volume of the rotary pump; and (d) at least a first setting chamber (22) for charging the setting structure (3) with a setting pressure of a setting fluid which acts in the second setting direction, (e) wherein the outer circumference of the setting structure (3) has (e1) a pressure setting surface (22*a*) which forms a movable delineating wall of the first setting chamber (22), and (e2) a pressure equalization surface (3*a*) which is permanently connected to the high-pressure side and is provided in order to charge the setting structure (3) with an external additional force ($F_a$) which acts in the first setting direction.

Aspect 4. The rotary pump according to any one of the preceding aspects, wherein the high-pressure space (21) is provided downstream of the delivery chamber outlet (20) and upstream of the housing outlet in the housing (1).

Aspect 5. The rotary pump according to any one of the preceding aspects, wherein at least most of the fluid which is delivered from the delivery chamber through the delivery chamber outlet (20) flows into the high-pressure space (21), preferably directly, and flows off out of the high-pressure space (21) via the housing outlet, such that at least most of the fluid, preferably all of the fluid, can flow off out of the pump from the delivery chamber via the high-pressure space (21).

Aspect 6. The rotary pump according to any one of the preceding aspects, wherein the normal vector of the pressure equalization surface (3*a*) has a setting direction component parallel to the setting directions as a whole, which is greater than zero, and a transverse component transverse to the setting directions as a whole, and the transverse component is more than three times or more than five times or more than ten times as large as the setting direction component.

Aspect 7. The rotary pump according to any one of the preceding aspects, wherein the high-pressure space (21) is connected in fluid communication to the delivery chamber via the setting structure (3).

Aspect 8. The rotary pump according to any one of the preceding aspects, wherein the pressure equalization surface (3*a*) is a movable delineating wall of the high-pressure space (21), and a pressure prevailing in the high-pressure space (21) acts on the setting structure (3) via the pressure equalization surface (3*a*), preferably towards the first setting chamber (22).

Aspect 9. The rotary pump according to any one of the preceding aspects, wherein a restoring element (4), preferably a spring, exerts a spring force which acts in the first setting direction on the setting structure (3).

Aspect 10. The rotary pump according to any one of the preceding aspects, wherein the setting movement of the setting structure (3) in the first setting direction increases the specific delivery volume, and the setting movement of the setting structure (3) in the second setting direction reduces the specific delivery volume.

Aspect 11. The rotary pump according to any one of the preceding aspects, wherein the fluid situated in the delivery chamber exerts a resultant internal force ($F_i$) on the setting structure (3) which acts in one of the setting directions, for example in the second setting direction.

Aspect 12. The rotary pump according to any one of the preceding aspects, wherein the setting structure (3) can be moved linearly back and forth in the first setting direction and in the second setting direction.

Aspect 13. The rotary pump according to any one of the preceding aspects, wherein the rotary pump has another, second setting chamber (23) for charging the setting structure (3) with a setting pressure of a setting fluid which acts in one of the two setting directions, wherein the second setting chamber (23) is provided for charging the setting structure (3) with a setting pressure of the setting fluid which preferably acts in the second setting direction.

Aspect 14. The rotary pump according to any one of the preceding aspects, wherein:

- the normal vector of the pressure equalization surface (3*a*) has a setting direction component parallel to the setting directions as a whole, which is greater than zero;
- the normal vector of the pressure setting surface (22*a*) of the first setting chamber (22) has a setting direction component parallel to the setting directions as a whole; and
- the setting direction component of the pressure setting surface (22*a*) of the first setting chamber (22) is at least three times or at least five times or at least ten times greater than the setting direction component of the pressure equalization surface (3*a*).

Aspect 15. The rotary pump according to any one of the preceding aspects, wherein:

- the outer circumference of the setting structure (3) has a first sliding surface (3*b*), for forming a first sealing gap with the housing (1), and a second sliding surface (3*c*) for forming a second sealing gap with the housing (1);
- the pressure equalization surface (3*a*) extends in the circumferential direction from the first sealing gap up to the second sealing gap; and
- the sliding surfaces (3*b*, 3*c*) are offset relative to one another, transversely with respect to the first and second setting directions,
- such that the normal vector of the pressure equalization surface (3*a*) for generating the external additional force ($F_a$) points counter to the first setting direction.

Aspect 16. The rotary pump according to the preceding aspect, wherein the transverse offset of the sliding surfaces (3*b*, 3*c*) provides an effective pressure equalization surface (3*a*'), on which a pressure prevailing in the housing (1) on the high-pressure side acts in the first setting direction in order to generate the external additional force ($F_a$).

Aspect 17. The rotary pump according to any one of the immediately preceding two aspects, wherein: the normal vector of the pressure equalization surface (3*a*) has a setting direction component parallel to the setting directions as a whole, which is greater than zero; the magnitude of this setting direction component corresponds to an effective pressure equalization surface (3*a*'); and the external additional force ($F_a$) corresponds to the product of the effective pressure equalization surface (3*a*') and the pressure prevailing in the high-pressure space (21).

Aspect 18. The rotary pump according to any one of the immediately preceding three aspects, wherein the setting structure (3) is supported on the housing (1) via the sliding surfaces (3*b*, 3*c*), in a sliding contact in each case, and is guided translationally, preferably linearly.

Aspect 19. The rotary pump according to any one of the immediately preceding four aspects, wherein the first sealing gap formed by means of the first sliding surface (3*b*) fluidically separates the high-pressure space (21) from the first setting chamber (22).

Aspect 20. The rotary pump according to any one of the immediately preceding five aspects, wherein the second sealing gap formed by means of the second sliding surface (3*c*) fluidically separates the high-pressure space (21) from the low-pressure space (11).

Aspect 21. The rotary pump according to any one of the preceding aspects, wherein:

- the outer circumference of the setting structure (3) has a first sliding surface (3*b*), a second sliding surface (3*c*), a third sliding surface (3*d*) and optionally one or more other sliding surfaces (3*e*, 3*f*) for sealing and/or supporting and guiding in a sliding manner through the housing (1);
- the first setting chamber (22) is arranged between the first sliding surface (3*b*) and the third sliding surface (3*d*) in the circumferential direction;
- the rotary pump comprises a restoring element (4) for exerting a spring force which acts on the setting structure (3) in the first setting direction;
- the restoring element (4) acts on the setting structure (3) between the second sliding surface (3*c*) and the third sliding surface (3*d*), preferably between the second sliding surface (3*b*) and the optional fifth sliding surface (3*f*); and
- the pressure equalization surface (3*a*) extends between the first sliding surface (3*b*) and the second sliding surface (3*c*).

Aspect 22. The rotary pump according to any one of the preceding aspects, wherein the high-pressure space (21) extends in the circumferential direction between a circumferential region of the setting structure (3) located on the low-pressure side and the first setting chamber (22) as well as any other optionally provided setting chamber (23).

Aspect 23. The rotary pump according to any one of the preceding aspects, wherein the first setting chamber (22) is actuated by a valve or is preferably connected permanently to the low-pressure side of the pump.

Aspect 24. The rotary pump according to any one of the preceding aspects in combination with Aspect 13, wherein the second setting chamber (23) is permanently connected to the low-pressure side of the pump or is preferably actuated by a valve.

Aspect 25. The rotary pump according to any one of the preceding aspects in combination with Aspect 13, wherein the first setting chamber (22) and the second setting chamber (23) are arranged next to one another in the circumferential direction of the setting structure (3).

Aspect 26. The rotary pump according to any one of the preceding aspects, wherein the external additional force ($F_a$) increases as the delivery rate of the rotary pump increases, and decreases as the delivery rate of the rotary pump decreases.

Aspect 27. The rotary pump according to any one of the preceding aspects, wherein the first setting chamber (22) and the high-pressure space (21) are arranged next to one another in the circumferential direction of the setting structure (3).

Aspect 28. The rotary pump according to any one of the preceding aspects, wherein the first setting chamber (22) and/or the second setting chamber (23) according to Aspect 13 is/are sealed off from the delivery chamber and/or the high-pressure space (21).

Aspect 29. The rotary pump according to any one of the preceding aspects, wherein a fluid connection between the delivery chamber and the high-pressure space (21) is formed by a cavity on an end-facing side of the setting structure (3) or by a passage through the setting structure (3).

Aspect 30. The rotary pump according to any one of the preceding aspects, wherein the high-pressure space (21) is an antechamber of the housing outlet.

Aspect 31. The rotary pump according to any one of the preceding aspects, wherein the setting fluid is diverted on the high-pressure side of the pump.

Aspect 32. The rotary pump according to any one of the preceding aspects, wherein the high-pressure space (21) has a permanent fluid connection to the high-pressure side of the pump.

Aspect 33. The rotary pump according to any one of the preceding aspects in combination with Aspect 9, wherein the restoring element (4) is situated in a restoring chamber, and the restoring chamber is connected to the low-pressure space or the low-pressure side of the housing (1) and/or to the delivery chamber inlet.

Aspect 34. The rotary pump according to any one of the preceding aspects in combination with Aspect 2 or Aspect 11, wherein the internal force ($F_i$) is dependent on the delivery rate of the rotary pump and increases as the delivery rate increases and decreases as the delivery rate decreases.

Aspect 35. The rotary pump according to any one of the preceding aspects in combination with Aspect 2 or Aspect 11, wherein the internal force ($F_i$) acts in the direction of reducing the specific delivery volume.

Aspect 36. The rotary pump according to any one of the preceding aspects in combination with Aspect 2 or Aspect 11, wherein the pressure equalization surface (3*a*) is configured in terms of its size and orientation such that the external additional force ($F_a$) acts counter to the internal force ($F_i$) and preferably compensates for the internal force ($F_i$).

Aspect 37. The rotary pump according to any one of the preceding aspects, wherein the external additional force ($F_a$) corresponds to an equalizing force which acts counter to the internal force ($F_i$).

BRIEF DESCRIPTION OF THE DRAWINGS

The invention is described below on the basis of example embodiments. Features disclosed by the example embodiments advantageously develop the subject-matter of the claims, the aspects and also the embodiments described above. There is shown:

DETAILED DESCRIPTION OF THE INVENTION

Figure 1:
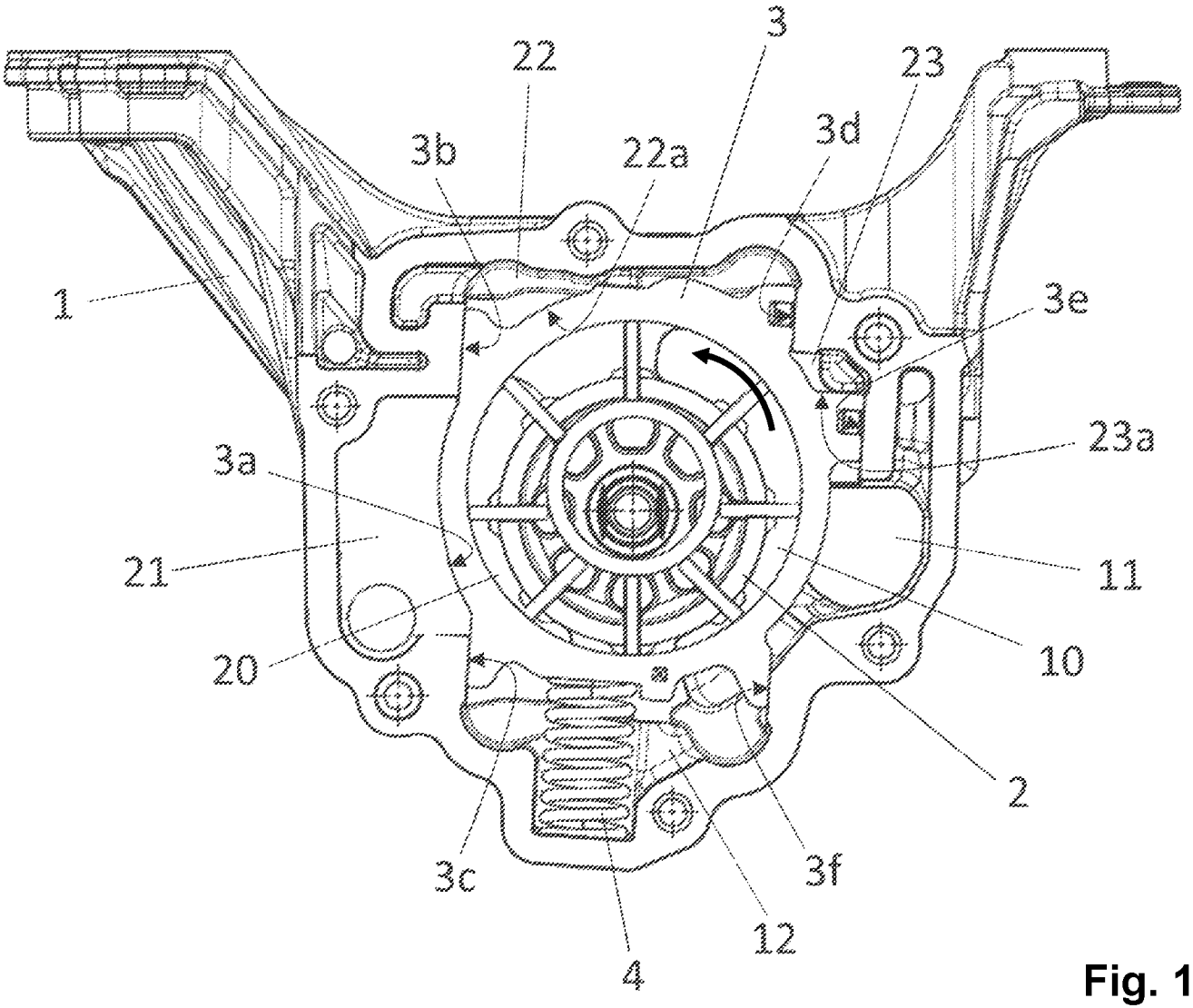
FIG. 1 a rotary pump having an adjustable delivery volume and a pressure equalization surface.

FIG. 1 shows a rotary pump having an adjustable delivery volume. The rotary pump is a vane cell pump. The rotary pump comprises a housing 1 featuring a housing inlet and a housing outlet for a fluid, for example lubricating oil or gear oil. The rotary pump also comprises a delivery rotor featuring a rotor 2, which can be rotated in the delivery chamber, and vanes which are movably guided by the rotor 2. The vanes are supported on the radially outer side on an inner contour of a setting structure 3 and sub-divide the delivery chamber into a plurality of delivery cells. The setting structure 3 delineates the delivery chamber radially outwards and serves to adjust the delivery volume.

Figure 2:
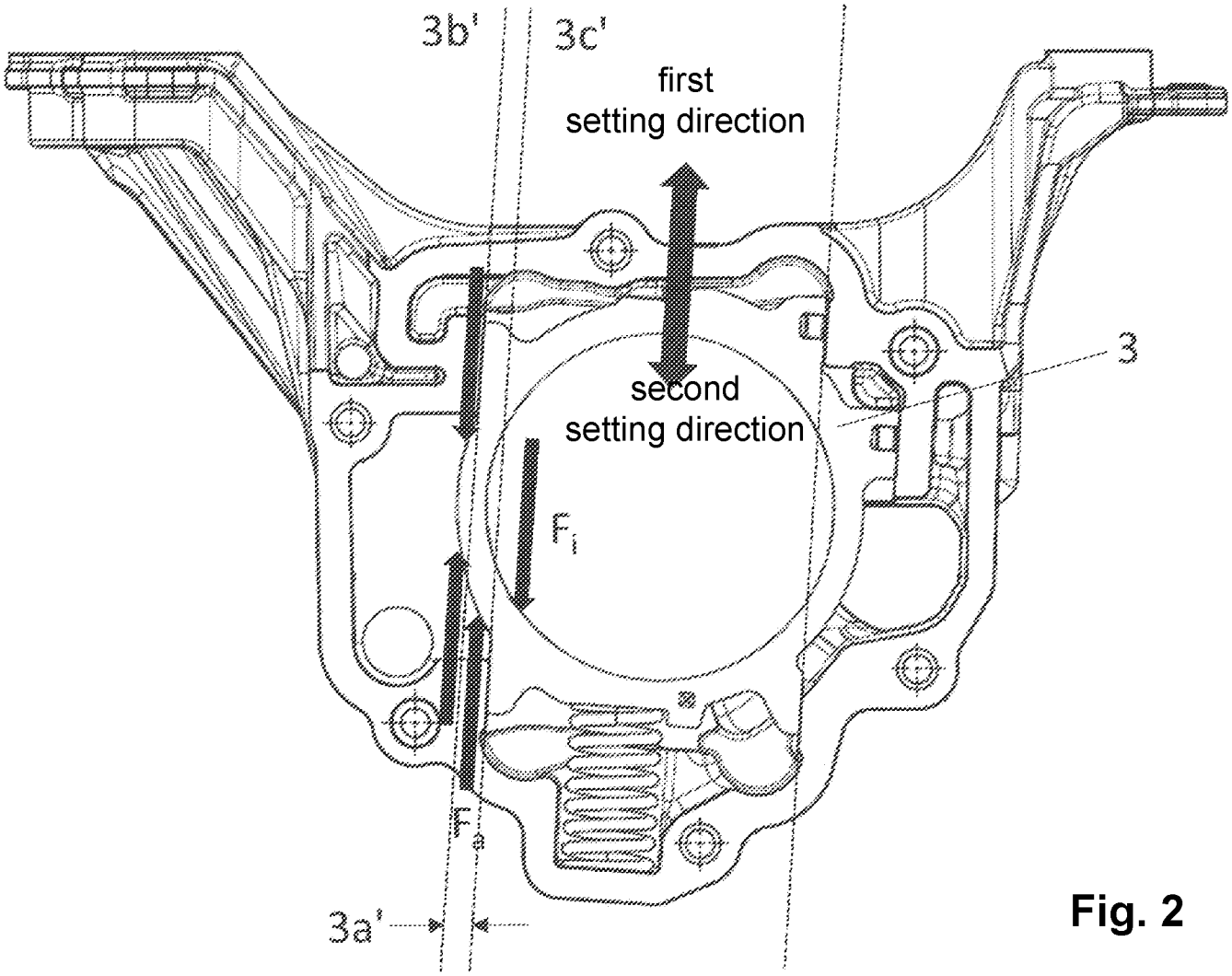
FIG. 2 the operating principle of the pressure equalization surface.

The setting structure 3 is mounted such that it can move back and forth, for example linearly, in a first setting direction and a second setting direction. The first setting direction and the second setting direction are indicated in FIG. 2 by a double-headed arrow in the upper region of the image. The outer circumference of the setting structure 3 has a first sliding surface 3*b*, a second sliding surface 3*c*, a third sliding surface 3*d*, a fourth slide surface 3*e* and a fifth sliding surface 3*f*. The sliding surfaces 3*b* to 3*f* are part of the outer circumferential surface of the setting structure 3. They can be formed directly by the setting structure 3 or by sealing elements which are arranged at the corresponding locations on the outer circumference of the setting structure 3 and/or in the complementary surfaces on the housing 1. The sliding surfaces 3*b* to 3*f* extend parallel to the first setting direction and second setting direction. The housing 1 guides the setting structure 3 in a sliding guide contact in the region of the sliding surfaces 3*b* to 3*f*. The first setting direction and the second setting direction are determined by the sliding surfaces 3*b* to 3*f* in the sliding guide contact.

A first setting chamber 22 and a second setting chamber 23 are formed in the housing 1. The first setting chamber 22 and the second setting chamber 23 are charged with pressure, wherein the first setting chamber 22 is permanently connected in fluid communication to the high-pressure side of the rotary pump, while the second setting chamber 23 can be selectively connected in fluid communication to the high-pressure side or the low-pressure side of the rotary pump via a control valve. The setting pressure prevailing in the first setting chamber 22 acts on the setting structure 3 in the setting direction. The setting pressure acting on the setting surface 22*a* generates a setting force in the setting direction. The setting surface 22*a* is part of the outer circumferential surface of the setting structure 3 and forms a movable wall of the first setting chamber 22. A restoring force acts in a restoring direction, counter to the setting force. The restoring force is generated by a restoring element 4, for example a restoring spring, which acts on the setting structure 3, wherein the restoring element 4 acts in the direction of increasing the delivery volume.

The restoring element 4 is arranged in a restoring chamber 12 which is preferably part of the low-pressure side of the pump, more specifically a low-pressure space 11 of the housing 1. The low-pressure space 11 is permanently connected fluidically to the housing inlet. The low-pressure space 11 is fluidically separated from the second setting chamber 23 in a circumferential direction by the sealing gap formed between the housing 1 and the setting structure 3 in the region of the sliding surface 3*e*. The low-pressure space 11 extends in the other circumferential direction up to the sealing gap formed in the region of the second sliding surface 3*c*. The restoring chamber 12 is attached to the low-pressure space 11 and is thus part of the low-pressure space 11. The sealing gap formed in the region of the second sliding surface 3*c* separates the high-pressure space 21 from the restoring chamber 12 and thus from the low-pressure space 11 of the housing 1. In modifications, the restoring chamber 12 can be permanently connected to the high-pressure side of the pump or selectively connected to and separated from the high-pressure side of the pump in order to relieve the restoring element 12 and/or to enable additional ways of adjusting the specific delivery volume.

If the restoring force and the setting force are in force equilibrium, the setting structure 3 is not moved. If the restoring force is greater than the setting force, the setting structure 3 is moved in the restoring direction. The restoring direction is referred to in the following as the "first setting direction". The setting direction in which the pressure prevailing in the first setting chamber 22 acts on the setting structure 3 is referred to in the following as the "second setting direction". If the setting force is greater than the restoring force, the setting structure 3 is moved in the second setting direction, against the restoring force of the restoring element 4, and the delivery volume is reduced, i.e. the pump is governed.

If the second setting chamber 23 is charged via the control valve with fluid from the high-pressure side of the pump, the fluid acts on the setting surface 23*a*, which forms a movable wall of the second setting chamber 23, and likewise generates a setting force in the second setting direction. The first setting chamber 22 and the second setting chamber 23 are arranged next to one another in the circumferential direction of the setting structure 3 and fluidically separated from one another by the sealing gap formed between the housing 1 and the setting structure 3 in the region of the third sliding surface 3*d*. The setting chambers 22 and 23 can in particular, as in the example embodiment, be arranged directly next to one another, separated from one another only by the sealing gap at 3*d*.

The rotary pump has a high-pressure space 21. The high-pressure space 21 is connected in fluid communication to the delivery chamber via the delivery chamber outlet 20. Although the delivery chamber outlet 20 is preferably formed by a pressure pocket in the housing 1 and a cavity in the setting structure 3 on the side of the setting structure 3 opposite the pressure pocket, the delivery chamber outlet 20 in FIGS. 1 and 2 is shown only as a pressure pocket in the housing. The explanations immediately above also apply analogously to the delivery chamber inlet 10. The high-pressure space 21 is separated from the delivery chamber only by the setting structure 3, as is preferred, and forms an antechamber to the housing outlet of the pump (not shown).

The high-pressure space 21 connects the high-pressure side of the delivery chamber to the housing outlet. When the pump is in operation, at least some of the fluid on the high-pressure side of the pump is discharged via the high-pressure space 21. Preferably, at least most of the fluid is discharged via the high-pressure space 21. The delivery chamber outlet is particularly preferably connected to the housing outlet via the high-pressure space 21 only, such that the entire delivery flow is discharged via the high-pressure space 21 when the pump is in operation.

The high-pressure space 21 is delineated inter alia by a pressure equalization surface 3*a*. The pressure equalization surface 3*a* is a circumferential portion of the outer circumferential surface of the setting structure 3 and forms a movable wall of the high-pressure space 21. The pressure equalization surface 3 exhibits a pressure surface asymmetry within the high-pressure space 21. The pressure surface asymmetry arises from an offset which the sliding surfaces 3*b* and 3*c* have relative to one another in a transverse direction with respect to the first and second setting direction of the setting structure 3. The sliding surfaces 3*b* and 3*c* are for example formed in the shape of projecting shoulders on the setting structure 3. The transverse offset provides the pressure equalization surface 3*a* with an asymmetry with respect to the first and second setting directions. The pressure equalization surface 3*a* has a remaining differential area in relation to the first and second setting directions, which is referred to in the following as the effective pressure equalization surface 3*a*' (FIG. 2). The effective pressure equalization surface 3*a*' lies between the sliding surfaces 3*b* and 3*c* as viewed in the circumferential direction. As is preferred, the sliding surfaces 3*b* and 3*c* delineate the pressure equalization surface 3*a* and therefore its effective pressure equalization surface 3*a*' in the circumferential direction. The pressure prevailing in the high-pressure space 21 generates a setting force, which acts on the setting structure 3 in the first setting direction, in accordance with the size of the transverse offset and by association in accordance with the size of the differential area and/or effective pressure equalization surface 3*a'*.

In the example embodiment, the setting structure 3 is broadly circular. The sliding surfaces 3*b* and 3*c* of the projecting shoulders are also offset transversely with respect to one another. The outer circumferential surface of the setting structure 3 describes a circular arc, which includes the equalization surface 3*a*, between the sliding surfaces 3*b* and 3*c* in the circumferential direction in the high-pressure space 21. The profile of the circular arc between the sliding surfaces 3*b* and 3*c* is however only one example of this outer circumferential portion of the setting structure 3.

If the sliding surfaces 3*b* and 3*c* (cf. FIG. 2) are notionally extended in the first setting direction and the second setting direction, the circumferential portion of the setting structure 3 enclosed by the parallel lines gives the effective pressure equalization surface 3*a*'. The effective pressure equalization surface 3*a*' is the projection of the enclosed circumferential portion in the first setting direction. The distance between the two parallel lines corresponds to the width of the effective pressure equalization surface 3*a*' as measured transversely with respect to the first and second setting directions.

The rotary pump has a low-pressure space 11 which is connected to the delivery chamber inlet 10 and the housing inlet (not shown). The low-pressure space 11 is preferably connected in fluid communication to the restoring chamber 12, such that the restoring chamber 12 and the low-pressure space 11 have the same pressure level.

The principle of the external additional force $F_a$ will be explained in the following on the basis of FIG. 2. For a better overview, the rotor and the vanes are not shown in FIG. 2.

An internal force is generated by the pressure conditions within the delivery chamber. The internal force has a force component $F_i$ in the second setting direction. The internal force can also have a force component orthogonal to the second setting direction, in this case preferably in the direction of the high-pressure space 21, since this at least partially compensates for the force exerted on the setting structure 3 by the pressure in the high-pressure space 21. The force component pointing in the second setting direction is referred to in the following as the internal force $F_i$. If the internal force also has a force component transverse to the first setting direction, both the force composed of the two force components and the force component acting in the second setting direction are referred to as the "internal force $F_i$". The fluid pressure prevailing in the high-pressure space 21 acts on the outer circumferential surface of the setting structure 3, i.e. on the pressure equalization surface 3*a*. At each point on the pressure equalization surface 3*a*, a force thus arises which is perpendicular to the outer circumferential surface at this point. Since only forces acting in the first setting direction and in the second setting direction are relevant to an unintentional change in the specific delivery volume, only the resultants of these forces are indicated in FIG. 2.

As already described at the beginning, the two sliding surfaces 3*b* and 3*c* of the setting structure 3 are offset with respect to one another, transversely with respect to the first and second setting directions. If the sliding surfaces 3*b* and 3*c* are notionally extended in the first setting direction and the second setting direction, the projection of the circumferential portion of the setting structure 3 enclosed by the parallel lines 3*b*' and 3*c*' corresponds to the effective pressure equalization surface 3*a*', wherein the distance between the two parallel lines corresponds to the width of the effective pressure equalization surface.

The fluid pressure which acts on the part of the pressure equalization surface 3*a* to the left of the parallel line 3*b*' generates forces whose force components in the first setting direction are equal in size to the force components in the second setting direction. These force components thus compensate for one another reciprocally. By contrast, the forces which act on the part of the effective pressure equalization surface 3*a* to the right of the parallel line 3*b*' generate a resultant force in the first setting direction. This resultant force is proportional to the size of the effective pressure equalization surface 3*a*' and serves to compensate for the internal force $F_i$. The resultant force generated by the effective pressure equalization surface 3*a* serves as an external additional force $F_a$ which is directed oppositely to the internal force $F_i$. The pump and its setting structure 3 can in particular be designed such that the internal force $F_i$ and the external additional force $F_a$ are equal in size and cancel one another out. The additional external force $F_a$ thus acts as an equalizing force for the internal force $F_i$.

The invention claimed is:

1. A rotary pump having an adjustable specific delivery volume the rotary pump comprising:

(a) a housing featuring a housing inlet and a low-pressure space, connected to the housing inlet, on a low-pressure side of the pump and featuring a housing outlet and a high-pressure space, connected to the housing outlet, on a high-pressure side of the pump;

(b) a delivery chamber into which a delivery chamber inlet connected to the low-pressure space opens on the low-pressure side and into which a delivery chamber outlet connected to the high-pressure space opens on the high-pressure side;

(c) a delivery rotor which is rotatable about an axis of rotation in the delivery chamber;

(d) a setting structure which is movable back and forth in a first setting direction and, counter to the first setting direction, in a second setting direction in order to perform a setting movement which adjusts the adjustable specific delivery volume of the rotary pump; and (e) at least a first setting chamber for charging the setting structure with a setting pressure of a setting fluid which acts in the second setting direction, (f) wherein the fluid pressure in the high-pressure space acts on a pressure equalization surface on an outer circumference of the setting structure, and the pressure equalization surface has a pressure surface asymmetry, resulting in an external additional force which acts on the setting structure in the first setting direction, and (g) wherein the external additional force corresponds to an equalizing force which acts counter to an internal force.

2. The rotary pump according to claim 1, wherein the high-pressure space is provided downstream of the delivery chamber outlet and upstream of the housing outlet in the housing.

3. The rotary pump according to claim 1, wherein at least most of the fluid which is delivered from the delivery chamber through the delivery chamber outlet flows into the high-pressure space and flows off out of the high-pressure space via the housing outlet, such that at least most of the fluid flows off out of the pump from the delivery chamber via the high-pressure space.

4. The rotary pump according to claim 1, wherein a normal vector of the pressure equalization surface has a setting direction component parallel to the setting directions as a whole, which is greater than zero, and a transverse component transverse to the setting directions as a whole, and the transverse component is more than three times or more than five times or more than ten times as large as the setting direction component.

5. The rotary pump according to claim 1, wherein the high-pressure space is connected in fluid communication to the delivery chamber via the setting structure.

6. The rotary pump according to claim 1, wherein the pressure equalization surface is a movable delineating wall of the high-pressure space, and a pressure prevailing in the high-pressure space acts on the setting structure via the pressure equalization surface.

7. The rotary pump according to claim 1, wherein a restoring element exerts a spring force which acts in the first setting direction on the setting structure.

8. The rotary pump according to claim 1, wherein the setting movement of the setting structure in the first setting direction increases the adjustable specific delivery volume, and the setting movement of the setting structure in the second setting direction reduces the adjustable specific delivery volume.

9. The rotary pump according to claim 1, wherein the fluid situated in the delivery chamber exerts a resultant internal force on the setting structure which acts in the second setting direction.

10. The rotary pump according to claim 1, wherein the setting structure is movable linearly back and forth in the first setting direction and in the second setting direction.

11. The rotary pump according to claim 1, wherein the rotary pump has another, second setting chamber for charging the setting structure with a setting pressure of a setting fluid which acts in one of the two setting directions, wherein the second setting chamber is provided for charging the setting structure with a setting pressure of the setting fluid.

12. The rotary pump according to claim 1, wherein:

a normal vector of the pressure equalization surface has a setting direction component parallel to the setting directions as a whole, which is greater than zero;

a normal vector of a pressure setting surface of the first setting chamber has a setting direction component parallel to the setting directions as a whole; and the setting direction component of the pressure setting surface of the first setting chamber is at least three times or at least five times or at least ten times greater than the setting direction component of the pressure equalization surface.

13. The rotary pump according to claim 1, wherein:

the outer circumference of the setting structure has a first sliding surface, for forming a first sealing gap with the housing, and a second sliding surface for forming a second sealing gap with the housing;

the pressure equalization surface extends in the circumferential direction from the first sealing gap up to the second sealing gap; and the first and second sliding surfaces are offset relative to one another, transversely with respect to the first and second setting directions, such that a normal vector of the pressure equalization surface for generating the external additional force points counter to the first setting direction.

14. The rotary pump according to claim 13, wherein the transverse offset of the first and second sliding surfaces provides an effective pressure equalization surface, on which a pressure prevailing in the housing on the high-pressure side acts in the first setting direction in order to generate the external additional force.

15. A rotary pump having an adjustable specific delivery volume the rotary pump comprising:

(a) a housing featuring a housing inlet and a low-pressure space, connected to the housing inlet, on a low-pressure side of the pump and featuring a housing outlet and a high-pressure space, connected to the housing outlet, on a high-pressure side of the pump;

(b) a delivery chamber into which a delivery chamber inlet connected to the low-pressure space opens on the low-pressure side and into which a delivery chamber outlet connected to the high-pressure space opens on the high-pressure side;

(c) a delivery rotor which is rotatable about an axis of rotation in the delivery chamber;

(d) a setting structure which is movable back and forth in a first setting direction and, counter to the first setting direction, in a second setting direction in order to perform a setting movement which adjusts the adjustable specific delivery volume of the rotary pump; and (e) at least a first setting chamber for charging the setting structure with a setting pressure of a setting fluid which acts in the second setting direction, (f) wherein the fluid pressure in the high-pressure space acts on a pressure equalization surface on an outer circumference of the setting structure, and the pressure equalization surface has a pressure surface asymmetry, resulting in an external additional force which acts on the setting structure in the first setting direction, and (g) wherein a normal vector of the pressure equalization surface has a setting direction component parallel to the setting directions as a whole, which is greater than zero, and a transverse component transverse to the setting directions as a whole, and the transverse component is more than three times or more than five times or more than ten times as large as the setting direction component.

16. The rotary pump according to claim 15, wherein:

the normal vector of the pressure equalization surface has a setting direction component parallel to the setting directions as a whole, which is greater than zero;

a normal vector of a pressure setting surface of the first setting chamber has a setting direction component parallel to the setting directions as a whole; and the setting direction component of the pressure setting surface of the first setting chamber (22) is at least three times or at least five times or at least ten times greater than the setting direction component of the pressure equalization surface.

17. The rotary pump according to claim 15, wherein:

the outer circumference of the setting structure has a first sliding surface, for forming a first sealing gap with the housing, and a second sliding surface for forming a second sealing gap with the housing;

the pressure equalization surface extends in the circumferential direction from the first sealing gap up to the second sealing gap; and the first and second sliding surfaces are offset relative to one another, transversely with respect to the first and second setting directions, such that the normal vector of the pressure equalization surface for generating the external additional force points counter to the first setting direction.

18. The rotary pump according to claim 17, wherein the transverse offset of the first and second sliding surfaces provides an effective pressure equalization surface, on which a pressure prevailing in the housing on the high-pressure side acts in the first setting direction in order to generate the external additional force.

19. A rotary pump having an adjustable specific delivery volume the rotary pump comprising:

(a) a housing featuring a housing inlet and a low-pressure space, connected to the housing inlet, on a low-pressure side of the pump and featuring a housing outlet and a high-pressure space, connected to the housing outlet, on a high-pressure side of the pump;

(b) a delivery chamber into which a delivery chamber inlet connected to the low-pressure space opens on the low-pressure side and into which a delivery chamber outlet connected to the high-pressure space opens on the high-pressure side;

(c) a delivery rotor which is rotatable about an axis of rotation in the delivery chamber;

(d) a setting structure which is movable back and forth in a first setting direction and, counter to the first setting direction, in a second setting direction in order to perform a setting movement which adjusts the adjustable specific delivery volume of the rotary pump; and (e) at least a first setting chamber for charging the setting structure with a setting pressure of a setting fluid which acts in the second setting direction, (f) wherein the fluid pressure in the high-pressure space acts on a pressure equalization surface on an outer circumference of the setting structure, and the pressure equalization surface has a pressure surface asymmetry, resulting in an external additional force which acts on the setting structure in the first setting direction, and (g) wherein:

a normal vector of the pressure equalization surface has a setting direction component parallel to the setting directions as a whole, which is greater than zero;

a normal vector of a pressure setting surface of the first setting chamber has a setting direction component parallel to the setting directions as a whole; and the setting direction component of the pressure setting surface of the first setting chamber is at least three times or at least five times or at least ten times greater than the setting direction component of the pressure equalization surface.

20. The rotary pump according to claim 19, wherein:

the outer circumference of the setting structure has a first sliding surface, for forming a first sealing gap with the housing, and a second sliding surface for forming a second sealing gap with the housing;

the pressure equalization surface extends in the circumferential direction from the first sealing gap up to the second sealing gap; and the first and second sliding surfaces are offset relative to one another, transversely with respect to the first and second setting directions, such that the normal vector of the pressure equalization surface for generating the external additional force points counter to the first setting direction.

21. A rotary pump having an adjustable specific delivery volume the rotary pump comprising:

(a) a housing featuring a housing inlet and a low-pressure space, connected to the housing inlet, on a low-pressure side of the pump and featuring a housing outlet and a high-pressure space, connected to the housing outlet, on a high-pressure side of the pump;

(b) a delivery chamber into which a delivery chamber inlet connected to the low-pressure space opens on the low-pressure side and into which a delivery chamber outlet connected to the high-pressure space opens on the high-pressure side;

(c) a delivery rotor which is rotatable about an axis of rotation in the delivery chamber;

(d) a setting structure which is movable back and forth in a first setting direction and, counter to the first setting direction, in a second setting direction in order to perform a setting movement which adjusts the adjustable specific delivery volume of the rotary pump; and (e) at least a first setting chamber for charging the setting structure with a setting pressure of a setting fluid which acts in the second setting direction, (f) wherein the fluid pressure in the high-pressure space acts on a pressure equalization surface on an outer circumference of the setting structure, and the pressure equalization surface has a pressure surface asymmetry, resulting in an external additional force which acts on the setting structure in the first setting direction, (g) wherein i. the outer circumference of the setting structure has a first sliding surface, for forming a first sealing gap with the housing, and a second sliding surface for forming a second sealing gap with the housing;

ii. the pressure equalization surface extends in the circumferential direction from the first sealing gap up to the second sealing gap; and iii. the first and second sliding surfaces are offset relative to one another, transversely with respect to the first and second setting directions, iv. such that a normal vector of the pressure equalization surface for generating the external additional force points counter to the first setting direction, and (h) wherein the transverse offset of the first and second sliding surfaces provides an effective pressure equalization surface, on which a pressure prevailing in the housing on the high-pressure side acts in the first setting direction in order to generate the external additional force.

* * * * *